US006004163A

United States Patent [19]

Behling et al.

[11] Patent Number: 6,004,163

[45] Date of Patent: Dec. 21, 1999

[54] ELECTRICAL MULTI-POLE PLUG-AND-SOCKET-TYPE CONNECTOR WITH ASSOCIATED SOCKET PART

[75] Inventors: Bernd Behling, Steinheim; Ralf Beckman, Detmold; Klaus Eisert, Blomberg, all of Germany

[73] Assignee: Phoenix Contact GmbH & Co., Blomberg, Germany

[21] Appl. No.: 09/125,136

[22] PCT Filed: Feb. 21, 1997

[86] PCT No.: PCT/EP97/00826

§ 371 Date: Aug. 11, 1998

§ 102(e) Date: Aug. 11, 1998

[87] PCT Pub. No.: WO97/33347

PCT Pub. Date: Sep. 12, 1997

[30] Foreign Application Priority Data

Feb. 21, 1996 [DE] Germany ..... 296 02 740

[51] Int. Cl.[6] ..... H01R 13/502

[52] U.S. Cl. ..... 439/701; 439/362

[58] Field of Search ..... 439/345, 362, 439/449, 470, 607, 610, 701

[56] References Cited

U.S. PATENT DOCUMENTS 4,464,003 8/1984 Goodman et al. .

FOREIGN PATENT DOCUMENTS 0246750 11/1987 European Pat. Off. .
0523491 1/1993 European Pat. Off. .
2329334 1/1975 Germany .
29508095 U 7/1995 Germany .

*Primary Examiner*—Khiem Nguyen
*Attorney, Agent, or Firm*—Charles E. Baxley, Esq.

[57] ABSTRACT

An electrical connector includes a frame which supports contact modules which are equipped with connections for a corresponding number of conductors of a multi-wire cable. The contact modules and corresponding female modules can be freely combined in their selection and arrangement and can be latched together to form compact module blocks.

10 Claims, 5 Drawing Sheets

ELECTRICAL MULTI-POLE PLUG-AND-SOCKET-TYPE CONNECTOR WITH ASSOCIATED SOCKET PART

BACKGROUND OF THE INVENTION

1. Field of the Invention

The present invention relates generally to the field of electrical connectors and more particularly to modular multi-pole connectors in which male and female contact inserts are latched into respective retaining frames to form contact insert blocks.

2. Prior Art

Electrical plug connectors of modular construction are known from EP 0 523 491 A1 as well as from various catalogs or product documents. One published product catalog November, 1992 Elektrische Bauteile (Electrical Components) from the company 2E Rolf Hiller describes a modular plug system as a board plug connector based on DIN 41612 whose modules, which can be inserted into a retaining frame, are designed as male and female strips and can be fitted with contacts of different shapes, by latching in, for the respective application. This system has no plug housing and in the male strip, which is designed as a male part, can be regarded more as a separable board connection than as an industrial plug. Depending on the fitting, the modules can be mounted on a printed circuit board, maintaining a basic grid. A retaining frame is used for mounting, and is provided on the board side as a collecting and alignment frame. The modules which are inserted into this retaining frame are available only as plug-in, crimped or soldered versions. Universal use by means of clamping or screw-clamping connection for wires and braids and PE contact-making integrated in the modular system are not provided.

The catalogs published by CONTACT Connectors 950331 EPIC Baureihe MC (EPIC MC series), Concept—Das modulare Steckverbindersystem (Concept—The modular plug connector system), INNOVATION, Title page plug connectors, Weidmüller, Amphenol C 146 Modular Catalog, euro publishing February, 1994 likewise describe modular plug connections of a common system which can be inserted and latched into a frame. In the case of this system, the individual modules are guided via side guide ribs and corresponding grooves running in the insertion direction in the retaining frame, and are attached to the latter via latching hooks. The modules are very robust and thus of a voluminous design, which leads to a considerable increase in the size of the contact grid. For bonding between the male part and the female part, early-make PE metal contacts are provided at the sides on the frame and outside the module arrangement on the narrow side of the plug connector, and these require additional installation space to allow the contact connection to spring out at the sides. In the case of plug connections which do not require bonding, this is at the expense of the number of contacts per plug connector. To this end, the fitting/base housings and the sleeve housings have been matched, in a robust configuration, to the particular requirements of rugged use and, as a rule, are made of metal. The shape of the housings in this case is matched to a mechanical hinged interlock system that is provided, and this requires additional installation space for the entire electrical plug connector.

OBJECTS AND SUMMARY OF THE INVENTION

It is therefore an object of the present invention to provide an electrical connector in which modular electrical contacts can be combined in a retaining frame.

Another object of the present invention is to provide an electrical connector which provides protection against the electromagnetic compatability problems.

Yet another object of the present invention is to provide an electrical connector which is reliable in operation and compact in size.

The foregoing and other objects and advantages of the present invention will appear more clearly hereinafter.

In accordance with the present invention there is provided an electrical connector of the type mentioned initially for Protection Class IP 65. The electrical connector incorporates PE contacts and modular contact inserts.

The present invention minimizes the disadvantages of the prior art and, for applications which do not require bonding, to make it possible for contact modules also to use the PE contact area, which is not required in these applications, on the narrow side of the plug connector, while maintaining the same plug area size. Thus, for such applications, it is possible to increase the number of contacts per plug connector and its installed volume. The present invention is intended to comply dimensionally with Protection Class IP65 and to allow use, on the one hand, with a plastic sleeve housing on devices, as well as in a second configuration with a metal housing for relatively rugged industrial purposes in extreme environmental conditions and with additional electromagnetic compatibility (EMC) protection, without any difference in size to that of a plastic housing and with the same physical size and different contact inserts.

Printed circuit board miniature plug connectors (which are known per se) can be combined with a mutually matching grid size in groups to form a module, and can be modified such that these modules can be arranged in a retaining frame, on the one hand as a male part of the sleeve housing, and on the other hand as a female part on the connection or equipment side. The arrangement is achieved in design terms in such a manner that the operating elements or openings point toward the longitudinal side of the retaining frame, in order to make it easier to wire up the individual terminal points. A plurality of modules with different contact inserts for power and/or signal transmission can thus be combined using a screw clamping or spring force clamping technique and can be arranged in a freely variable sequence corresponding to the specified grid size of the retaining frame.

An additional feature of the present invention relates to the overall thickness of the retaining frame. By minimizing the wall thickness of the retaining frame on the male side in the same way as the fitting frame on the equipment side, it is possible to allow optimum utilization of the plug connector area for the number of modules to be inserted. This is achieved as a result of the fact that, in the case of one embodiment of the invention, the design of the retaining frame dispenses with sprung PE metal parts for making early contact, which PE metal parts (which are permanently installed on the retaining frame) are normally firmly and integrally connected to the retaining frame at the ends in the longitudinal direction of the plug connector.

In the situation where early-make PE contacts are required, a special retaining frame is provided as a fitting kit and is matched to the modularity of the plug connector modules, in which fitting kit PE contacts of modular form and using half the module grid size are provided at the outer ends of the retaining frame in the longitudinal direction, which contacts together produce an entire module and are connected to one another via a link which is mounted longitudinally on the inside of the frame and is made of electrically conductive material as flat strip or round wire. A PE conductor which forms part of the conductor cable can be connected to this PE module in the sleeve housing.

In an additional embodiment of the invention the female part of the electrical connector, which is normally mounted on the fitting frame on the equipment or fitting side or on an industrial 19" rack, can also, in its configuration as a mating piece, be used to form the male part without a PE connection, as well as to form a male part with PE modules. To this end, the fitting frame for the application without PE connection is designed as the mating part for the male side to a maximum number of connector modules. For use with PE contacts, the modular breakdown of the fitting frame is matched to the position of the modules on the plug side, and likewise has a push-in link made of electrically conductive metal strip or round wire, which is connected at the other female part end to a PE module which can be latched into the retaining frame. This has the advantage that all that need be mounted is one continuing PE connection, irrespective of whether this is a conductor track on a printed circuit board or a conductor which can be clamped on freely.

It is also advantageous for the contact inserts on the fitting or equipment side to be latched to one another using latching means on the side surfaces of the individual modules to form a block, which leads to additional stability of the contact inserts in the female part and, furthermore, in the overall plug connector. The combination of contact inserts for making contact with a printed circuit board and contact inserts for connection of continuing flexible electrical conductors is also advantageous. Each of these different contact inserts can be permanently connected to a module using a different type of connection technique, via latching pieces or dovetail guides provided at the sides of these modules, to form a block.

A further feature is the design arrangement, intended for electromagnetic compatibility (EMC) protection of a shielding plate between the metal sleeve housing intended for this purpose and a retaining frame which is intended for positioning of the sleeve housing on the front of the equipment on the fitting side and, at the same time, is also the retaining part for the female contact modules on the equipment side. From the equipment side, this shielding plate encloses the retaining frame so that once the shielding plate has been inserted with the fitting frame into the equipment connecting opening, a contact is at the same time provided with the edge of the equipment front opening via a plurality of sprung subelements of the shielding plate, which are supported on the longitudinal side of the retaining frame.

On the other hand, it is possible for the plug and the front of the equipment to be connected via the fitting flanges to PE connections on a printed circuit board (PCB). For this purpose, the metal parts are designed as attachment elements of the fitting flange so that it is possible to make contact with a conductor track on a printed circuit board (PCB).

Protection Class IP 65 for the entire plug connector design is in this case achieved via a groove, which is provided toward the contact surface in the sleeve housing wall of the plastic and/or metal housing and a cord seal which is inserted into this groove and projects toward the contact surface of the plug connector and which, as a result of the plug connector sleeve being screwed to an equipment wall, produces a seal between the two parts. This design is advantageous and cost-effective since, in consequence, there is no need for a plug connector fitting housing with additional sealing toward the equipment wall and the additional installation area connected to it.

BRIEF DESCRIPTION OF THE DRAWINGS

Other important objects and advantages of the present invention will be apparent from the following detailed description taken in connection with the accompanying drawings wherein like numerals refer to like parts and in which.

DETAILED DESCRIPTION OF THE INVENTION

Figure 1:
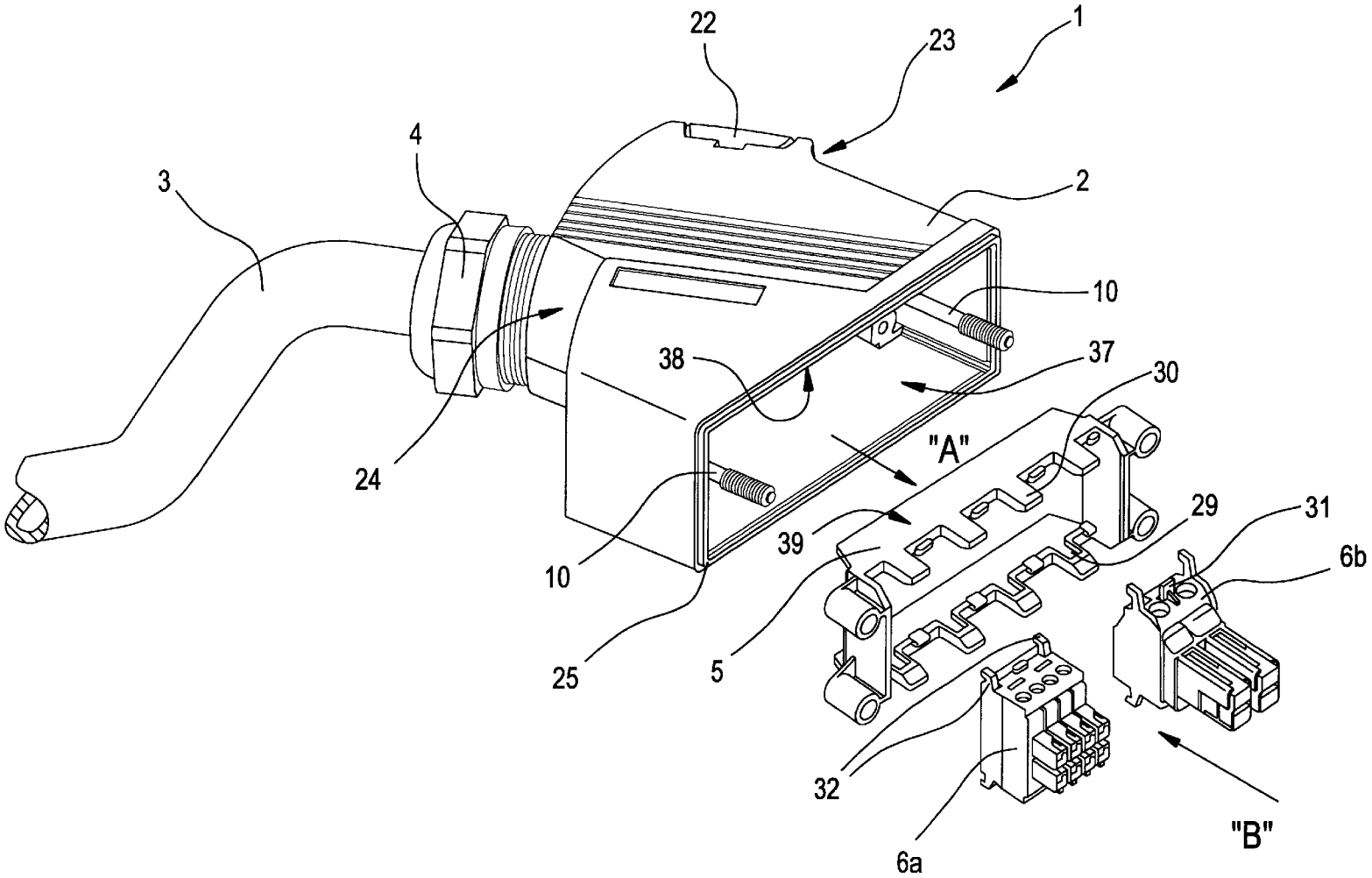
FIG. 1 is an exploded perspective view of an electrical multi-pole plug and socket type connector with associated socket part made in accordance with the present invention showing a first part of a sleeve housing 2 of an electrical plug connector 1 with a multicore conductor cable 3 connected, a cable gland 4 with strain relief, a withdrawn retaining frame 5 and two different contact modules 6*a*, 6*b*which can be latched in the retaining frame 5.

Referring to the drawings, wherein like reference numbers designate like or corresponding parts throughout, there is shown in FIGS. 1–5 an electrical multi-pole plug and socket type connector with associated socket part made in accordance with the present invention.

Figure 2:
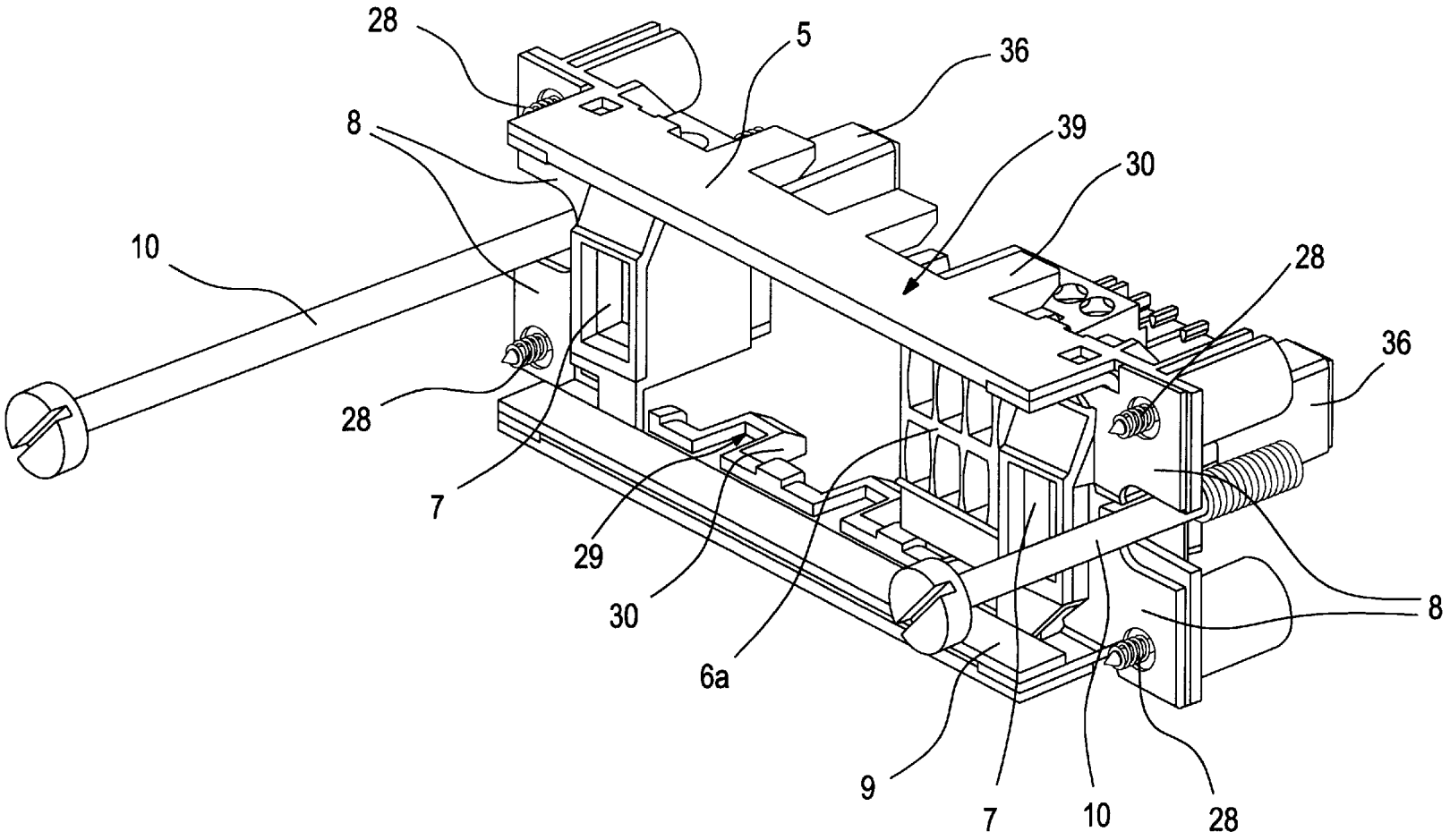
FIG. 2 is an exploded perspective view of the retaining frame 5 with PE contacts, taken in the direction "A", in FIG. 1, and with contact modules 6*a*, 6*b* latched in, PR modules 7 which are arranged integrally on the retaining frame 5 and their connection to an electrically conductive metal part 8 via a link 9 which is fitted on the retaining frame 5, and the position of the fastening screws 10 in the sleeve housing 2.
Figure 3:
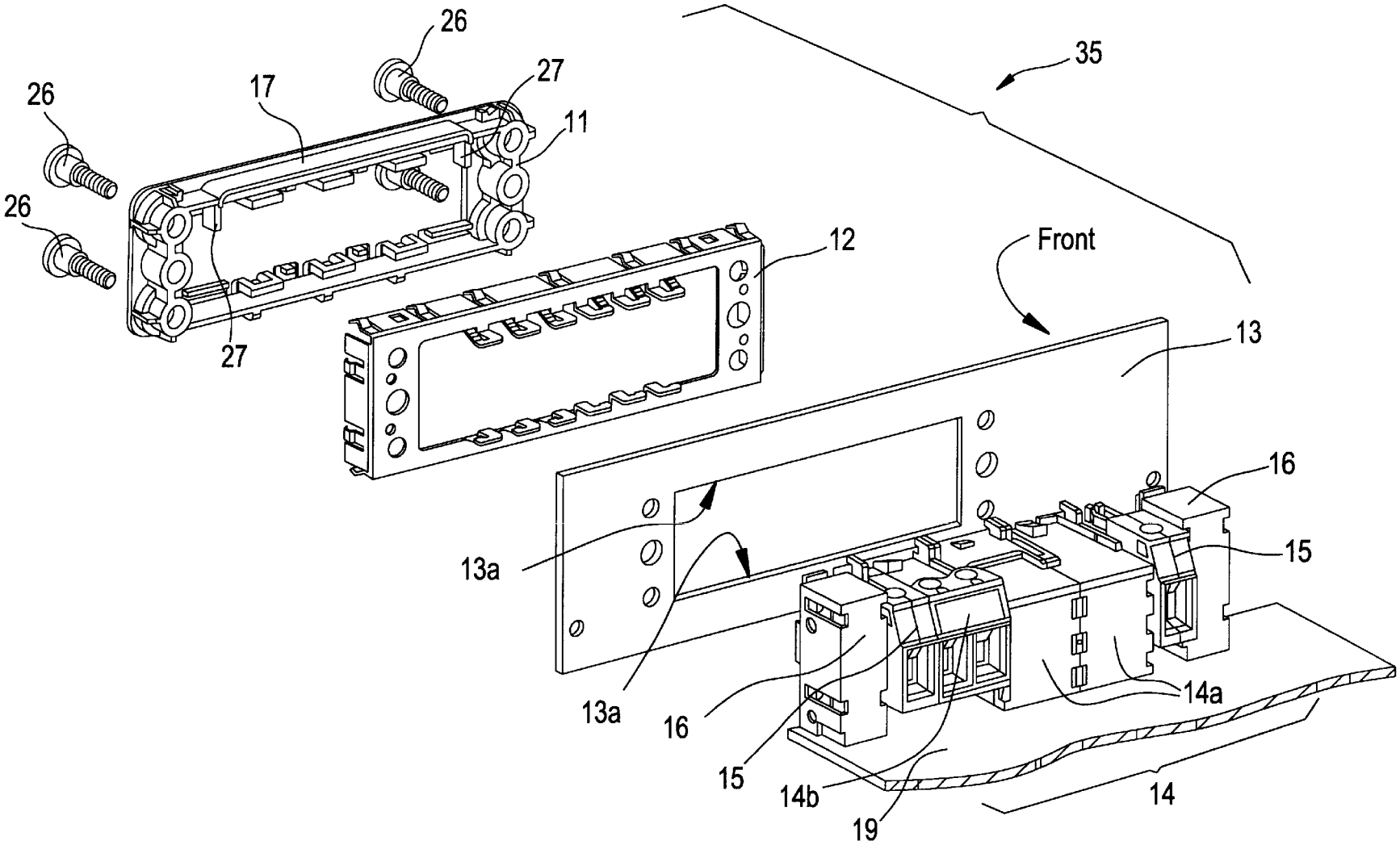
FIG. 3 is an exploded perspective view of the fitting parts of the front of a piece of equipment in an embodiment with PE contacts and their arrangement in the fitting frame 11 on the equipment side, with the link 17 inserted, the position of the shielding plate 12, a front panel 13 of a piece of equipment and one possible arrangement of a module block 14 of printed circuit board female modules 14*a*, 14*b* and fitting flanges 16, as well as PE modules 15 for making contact with free electrical conductors 20.

FIG. 1 shows a first portion of an electrical connector 1, the male part comprising a sleeve housing 2, a retaining frame 5 and at least one contact module 6*a*, 6*b* which can be latched into this retaining frame 5, a PG gland 4 for mechanical and sealed attachment of a conductor cable 3 to the clamping and sealing elements which are normal therein, the fastening screws 10 for fastening the sleeve housing 2 on a front of an equipment wall 13, as illustrated in FIGS. 3 and 6, and a seal 25 which is inserted in an advantageous manner in a groove in the contact surface of the housing sleeve and, together with the PG gland 4, allows the entire electrical plug connector to be sealed to IP 65. This saves an additional seal in a base part, as well as the base part itself. These parts are supplemented by the fastening parts 28, which can be seen in FIG. 2. The retaining opening 37 for the sleeve housing 2 has a rectangular cross section with contact surfaces which are formed on the longitudinal sides 38 and interact with the longitudinal sides 39 of the elongated retaining frame 5.

Once the outer sheath of insulation has been stripped off the conductor cable 3 for a specified length, the individual cores in the conductor cable are inserted, after the cable gland with strain relief 4 has been passed over them, into the gland opening in the sleeve housing 2 and are then prepared for clamping contact to be made with them. Furthermore, the retaining frame 5 is fitted with the sequence of different or identical contact modules 6*a*, 6*b* simply by latching in the mating direction "B". The retaining frame 5 is advantageously and cost-effectively manufactured from plastic and, for attachment of the contact modules 6*a*, 6*b*, has pieces 30 which are structurally designed and project counter to the mating direction "B", on which pieces 30 undercuts 29 are provided on the inside of the retaining frame 5, in order to accommodate latching pieces 31 which project at right angles to the mating direction "B" of the contact modules 6*a*, 6*b*. When the retaining frame 5 is in the unmated state, this connection into the sleeve housing 2 can be released without applying any major force by slightly bending up the retaining frame 5 so that the position of a contact module 6*a*, 6*b* can be moved directly.

In the state when the contact modules 6*a*, 6*b* are completely latched in the retaining frame 5, the individual conductors of the conductor cable 3 can be connected to the contact modules 6*a*, 6*b*. For this purpose, the structural design of the contact module 6*a*, 6*b* has advantageously been provided such that the operating elements for the clamping connection point toward the longitudinal side 39, 39*a* of the retaining frame 5 and are not covered by the projecting pieces 30 of the retaining frame 5.

Once all the individual conductors in the conductor cable 3 have been connected, the retaining frame 5 is pushed with latched-in contact modules 6*a*, 6*b* into the sleeve housing 2 in the mating direction "B", the individual conductors in the conductor cable 3 being located in the interior of the sleeve housing 5. The retaining frame 5 is screwed by means of fastening elements 28 according to FIG. 2 to the sleeve housing 2, in the mating direction "B", in the interior of the sleeve housing. Once the retaining frame 5 is firmly seated, it is no longer possible to remove a connector module 6*a*, 6*b* since the inner contact surfaces 38 of the sleeve housing 2 as a shaped element counteract the widening of the longitudinal sides 39 of the retaining frame 5.

Supports 32 which project at the side are provided on the plastic housing part of the contact module 6*a*, 6*b* in order to support and to position the contact modules in the mating direction "B", are supported on the edge of the retaining frame 5 in the mating direction "B" and have side supports 32 which engage around the edge of the longitudinal side 39 of the retaining frame 5 and counteract any movement of the contact module 6*a*, 6*b* transversely with respect to the mating direction "B" as well as any widening of the retaining frame 5 as well as preventing the connector modules 6*a*, 6*b* from becoming loose.

FIG. 2 shows a perspective view of the partially fitted retaining frame 5 of an alternative embodiment of the invention for making PE contact. The projecting latching piece holders 30 of the retaining frame 5 are illustrated, with the undercuts 29.

It is often necessary to pass and to transfer an electrical potential via wiring to a piece of equipment for protection of the electronic components located in it. In an alternative embodiment of the electrical connector 1, this electrical potential is transferred from the male side to the equipment side by the provision of a PE module 7 for this purpose, which is designed in the form of a contact module 6*a*, 6*b* and makes contact on the equipment side in FIG. 3 with a PE female module 15 which can be inserted.

The embodiment of the invention shown in FIG. 2 provides fixed PE contacts 7 in a retaining frame and, at the same time, does not make it impossible to continue to fit contact modules 6*a*, 6*b* at the sides. The structural design of these PE modules 7, which can be latched in and are thus firmly connected to the retaining frame 5, in the shape and grid of the contact modules 6*a* preferably allows the interchangeable use of PE female mating pieces 15 on the equipment side. The PE female modules 15 may be designed both with a free conductor connection and with plug or solder connections for making contact with a printed circuit board.

For this purpose, it is advantageously provided in one structural variant for the retaining frame 5 and the fitting frame 11 to be formed integrally with the retaining frame 5 at both ends, in a version as a PE module 7 and in each case being half the width of the contact module 6*a* and for a prefabricated electrically conductive metal part 8 to be inserted with a connected link 9 between the outer metal parts 8 which, in turn, make electrical contact at the sides with the clamped connection of the conductor connection of the PE module 7. In another structural variant, a PE module 7, which can be plugged in and latched and is once again half as wide as the contact module is possible, the contact-making metal parts being matched to this structure. The configuration of the fitting frame with PE contact-making is assembled in a fitting kit. The mutually matchine PE modules 7, 15 of the plug connector 1 and of the female part 35 (FIG. 3) have early-make contacts 36.

FIG. 3 shows the fitting side (equipment side), namely the female part 35 with the components required for connection to an equipment front cover 13. In the case of this configuration the structural design of the fitting frame 11 includes an attachment and a positioning flange for the sleeve housing 2 on the one hand and on the other hand serves as a guiding fitting frame 11 for the female modules 14*a*, 14*b*, 15 which are positioned as mating pieces for the plug side.

The female modules 14*a*, 14*b*, 15 can be fitted, in a corresponding manner to the plug side, with the same mutual sequence by latching in so that the latching-in technique required for this purpose is used by means of the elements 29 to 32 (in FIGS. 1 and 2) on the plug side.

In practice, the female modules 14*a* on the equipment side are connected to printed circuit boards (PCBs) 19 directly electrically as well as by means of a push-in technique. To this end, it is advantageous to clip the connecting modules together to form blocks 14 according to FIG. 3.

Figure 5:
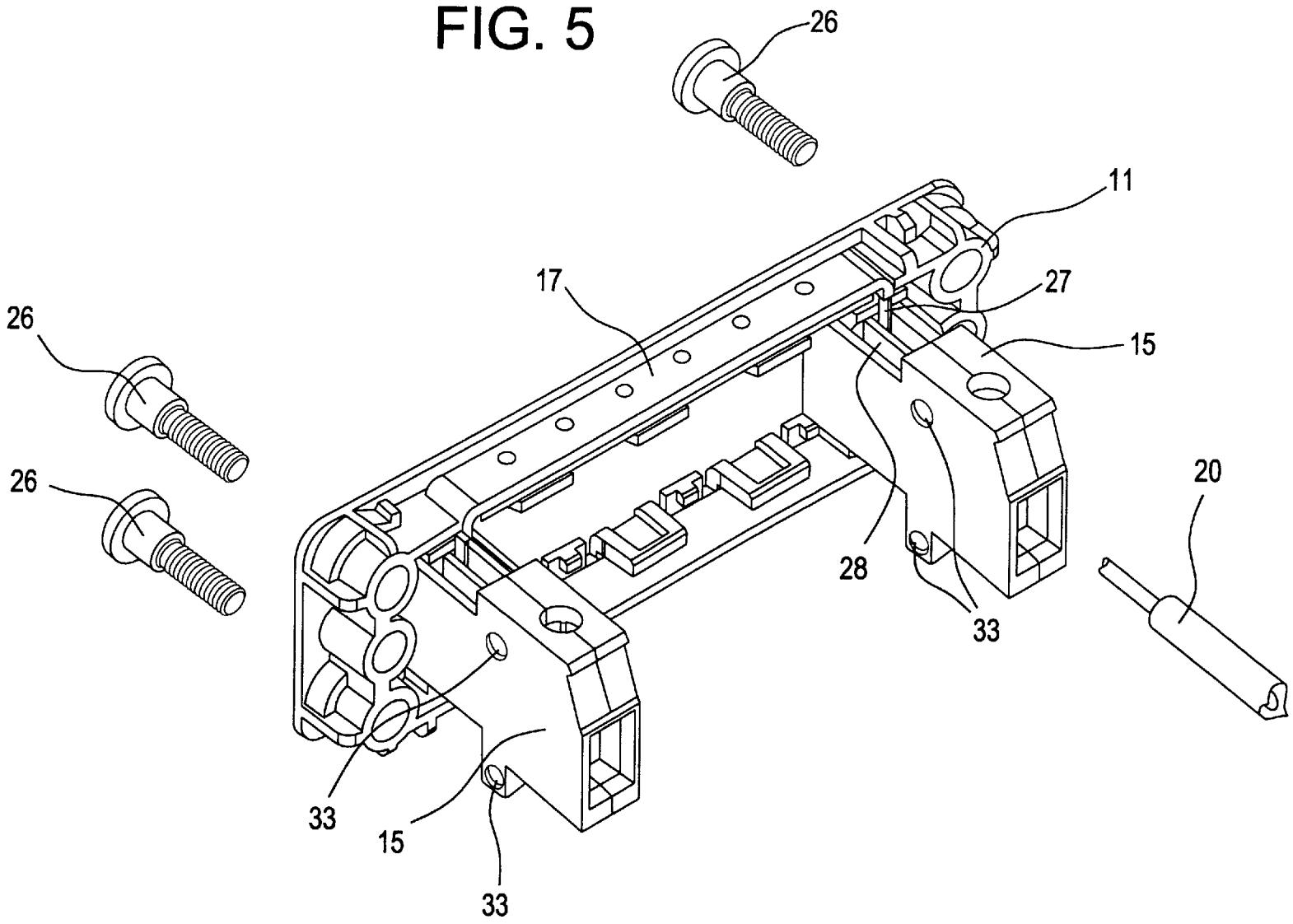
FIG. 5 is an exploded perspective view of the arrangement of PE modules 15 on the fitting frame 11 with the position of the push-in link 17 on the retaining frame 11 being illustrated, and its contacts at the side with the spring contacts 28 of the PE modules 15, which are illustrated here in a preferred manner as connectors for free conductors 20.

According to FIG. 5, conventional latching means 33, such as conical pins pointing toward one another and undercut holes and/or dovetail tongues and grooves, are provided at the sides on each female module 14*a*, 14*b*, 15. Alternatively, female modules 14*b* for free conductor connection can be latched together with the printed circuit board variant (which can be soldered or pushin in) of the female modules 14*a* by means of the connection capability 33 at the sides, to form blocks 14. The latched-together module blocks 14 can be soldered on the printed circuit board 19 and, as a total entity in the form of a module block 14, can be pushed into the fitting frame 11 and latched. To this end, the fitting frame 11 is held on the housing front cover 13 from the plug side (FIG. 3) by means of the connecting elements 26, in which case the connector block 14 is latched from the rear side of the housing front cover 13 into the fitting frame 11 in the form described above, so that the housing front cover 13 is clamped in between the fitting frame 11 and the female modules 14*a*, 14*b*, 15. In addition, on the board side of the housing front cover 13 into the fitting frame 11 in the form described above, so that the housing front cover is clamped in between the fitting frame 11 and the female modules 14*a*, 14*b*, 15. In addition, on the board side of the housing front cover 13, fitting attachment flanges 16 are provided on both sides of the module block 14 and can be latched on one side to the female modules 14*a*, 14*b*, 15, but on the other side pull the fitting frame 11 against the housing front cover 13, position it and secure it by means of the connecting elements 26.

In addition, a line 17 is provided on the equipment side for connection of the respective PE female modules 15, which are provided at one end of the module block 14, as a mating piece for the plug variant with PE modules 7. To this end, those PE contact modules 15 which can be plugged on on the equipment side but are not firmly connected to the fitting frame 11 are equipped in their upper, opened housing part 15 and on the side facing away from the printed circuit board 19 with sprung contact elements 28, which can be seen in FIG. 5, into which the bent electrically conductive end pieces 27 of the link 17 can be inserted, and contact-making is thus provided for passing onto a PE female module clamping connector which makes the electrical connection for the printed circuit board or, as illustrated in FIG. 3 and FIG. 5, to free PE conductors 20.

Figure 4:
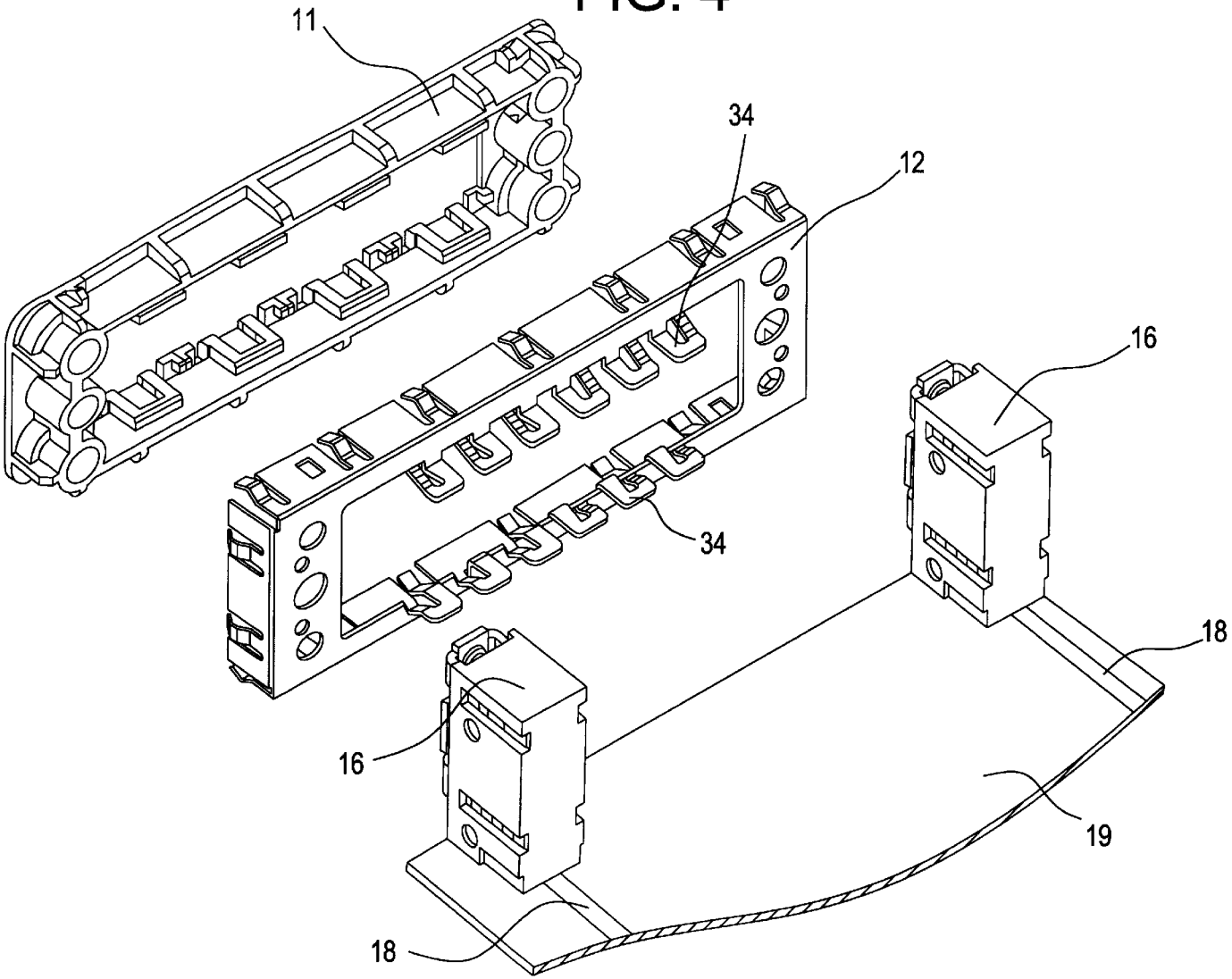
FIG. 4 is an exploded perspective view of the arrangement for connecting the fitting frame 11, the shielding plate 12 and the fitting flanges 16 in a configuration without PE contact, in which the shielding plate 12 makes contact by means of sprung contacts 34 with the inner edge of the retaining opening 13*a* on the front of the equipment 13, and in which case it is possible to connect the shielding plate 12 and the front of the equipment 13 to conductor tracks 18 on a printed circuit board 19 to the front of the equipment 13 is provided via the fitting flanges 16.

In an electromagnetic compatibility (EMC) protected embodiment of the electrical connector 1, shown in FIG. 4, a shielding plate 12 is proposed which is placed on the equipment side before the fitting frame 11 is mated with the housing front cover 13 via the fitting frame 11 and is secured together with this on the housing front cover 13, the sprung electrically conductive shielding plate contacts 34 producing electrical contact with the inner edge 13*a* of the housing front cover opening.

To this end, FIG. 4 illustrates the electromagnetic compatibility (EMC) variant with the PE contact with a printed circuit board track, the equipment front side and its opening not being illustrated, in order to illustrate the detail. Even in FIG. 3, it can be seen that the sprung shielding plate contacts 34 can make contact with the inner edge of the retaining opening on the front of the piece of equipment, so that the fitting attachment flanges 16 do not necessarily need to make a connection with the shielding plate 12, since the housing front cover 13 of the equipment can be electrically insulated by, for example, a varnish coating. FIG. 4 illustrated an application in which the metal parts of the fitting attachment flanges 16 are designed such that, on the one hand, they can make contact with a conductor track 18 on a printed circuit board 19 and, on the other hand, can produce a connection for the housing front cover 13 by means of the metal parts of the fitting attachment flanges 16.

FIG. 5 furthermore shows the connection and arrangement between the electrically conductive link 17 and the PE female modules 15 for passing on the PE to free conductors 20. The link 17 is in this case bent at its ends 27, in the illustrated configuration preferably being bent at right angles and, by means of the projecting end pieces 27, makes contact with electrically conductive contact spring elements 28 of the PE female module 15, in its upper housing region which is open toward the link 17. In the lower region of the PE female module 15, the electrical contact is preferably equipped to form a pin contact as a mating piece to the PE module 7, which is provided in the male part, with a contact spring element, in which case this pin contact on the female module 15 is in turn integrally connected to the contact spring elements 28. These female modules 15 also have side latching means 33 in order to arrange them in a row to form a module block 14.

The following is a list of reference symbols as set forth in the foregoing Specification:

| Numeral | Refers to: |
|---|---|
| 1 | Plug connector |
| 2 | Sleeve housing |
| 3 | Conductor cable, multi-core |
| 4 | Cable gland with strain relief |
| 5 | Retaining frame |
| 6 | Contact module |
| 6a | Contact module, 8-way |
| 6b | Contact module, 2-way |
| 7 | PE module |
| 8 | Metal part, electrically conductive |
| 9 | Link, plug side |
| 10 | Fastening screw |
| 11 | Fitting frame |
| 12 | Shielding plate |
| 13 | Housing front cover |
| 14 | Module block |
| 14a | Female module, which can plugged in/soldered |
| 14b | Female module, free conductor outgoer |
| 15 | PE female module |
| 16 | Fitting attachment flange |
| 17 | Link, socket side |
| 18 | PE conductor track |
| 19 | Printed circuit board (PCB) |
| 20 | Free conductor |
| 21 | Grip for user |
| 22 | Marking plate |
| 23 | Projection |
| 24 | Grip side |
| 25 | Seal |
| 26 | Fastening screws |
| 27 | Link end piece |
| 28 | PE socket metal |
| 29 | Latching piece retaining depression |
| 30 | Latching piece holder |
| 31 | Latching piece |
| 32 | Side support |
| 33 | Side module latching |
| 34 | Shielding plate contact |
| 35 | Female part |
| 36 | Early-make contact |
| 37 | Retaining opening |
| 38 | Longitudinal side of the sleeve housing |
| 39 | Longitudinal side of the retaining frame |

The foregoing specific embodiments of the present invention as set forth in the specification herein are for illustrative purposes only. Various deviations and modifications can be made within the spirit and scope of this invention, without departing from the main theme thereof.

We claim:

1. An electrical multi-pole plug connector having an associated female part, the two of which each have a frame for accommodating contact modules which correspond to one another and are equipped with connections for a corresponding number of conductors, wherein two PE modules (7, 15) can in each case optionally be inserted, instead of at least one contact module (6*a*, 6*b*), in the frame (5) of the plug connector (1) and in the frame (11) of the female part (35), which PE modules (7, 15) have early-make contacts (36) which make contact with one another first of all when the plug connector (1) and the female part (35) are mated, and wherein a link (9, 17) which connects the respective two PE modules (7, 15) and is composed of electrically conductive material can respectively be fitted to the frame (5, 11).

2. The plug connector as claimed in claim 1, wherein the PE modules (7, 15) of the plug connector and/or of the female part (35) have a connection for a free conductor (20).

3. The plug connector as claimed in claim 1, wherein the PE modules (15) of the female part (35) have plug-in or solder connections for making contact with a printed circuit board (19).

4. The plug connector as claimed in claim 3, wherein fitting flanges (16), which can be screwed to the frame (11) of the female part (35), are firmly arranged on the printed circuit board (19) and can be latched to the PE modules (15) of the female part (35) with the printed circuit board (19).

5. The plug connector as claimed in claim 1, wherein the contact modules (6*a*, 6*b*) have a module width with the same pitch, and the PE modules (7, 15) have half the width of the contact modules.

6. The plug connector as claimed in claim 1, wherein the contact modules (6*a*, 6*b*) and the PE modules (7, 15) have side latching means (33).

7. The plug connector as claimed in claim 1, wherein the link (9,17) which connects the PE modules (7, 15) is composed of flat strip or round wire.

8. The plug connector as claimed in claim 7, wherein the link (9, 17) which connects the PE modules (7, 15) is arranged internally or externally on the frame (5, 11).

9. The plug connector as claimed in claim 7, wherein the link (17), which connects the PE modules (15) of the female part (35), makes contact with a shielding plate (12) which surrounds the frame (11) and, in the mated arrangement, is connected to the sleeve housing (2) of the plug connector (1).

10. The plug connector as claimed in claim 9, wherein instead of the PE modules (15) of the female part (35), the fitting flanges (16) on the printed circuit board (19) are electrically connected to the shielding plate (12) and to PE conductor tracks (18) which are arranged on the printed circuit board (19).

* * * * *